United States Patent [19]

Kotauschek

[11] 4,450,800

[45] May 29, 1984

[54] LIGHT METAL CYLINDER HEAD FOR INTERNAL COMBUSTION ENGINE

[75] Inventor: Walter Kotauschek, Cologne, Fed. Rep. of Germany

[73] Assignee: Klöckner-Humboldt-Deutz AG, Cologne, Fed. Rep. of Germany

[21] Appl. No.: 329,957

[22] Filed: Dec. 11, 1981

[30] Foreign Application Priority Data

Dec. 13, 1980 [DE] Fed. Rep. of Germany ..... 3047037

[51] Int. Cl.[3] ..... F02F 3/04; F02F 1/24

[52] U.S. Cl. ..... 123/193 CH; 123/193 H; 277/236

[58] Field of Search ..... 123/193 H, 193 CH; 277/236

[56] References Cited

U.S. PATENT DOCUMENTS 1,673,776 6/1928 Moore ..... 277/236
2,804,866 9/1957 Kloss ..... 123/193 CH
4,387,678 6/1983 Tholen ..... 123/193 H

FOREIGN PATENT DOCUMENTS 826893 1/1960 United Kingdom .
989940 4/1965 United Kingdom .

*Primary Examiner*—Craig R. Feinberg
*Assistant Examiner*—David A. Okonsky
*Attorney, Agent, or Firm*—Watson, Cole, Grindle & Watson

[57] ABSTRACT

A cylinder head of light metal for connection by threaded fasteners with a cylinder or crankcase of an internal combustion engine has an insert formed in the head at the hottest spot thereof in the vicinity of the exhaust passage and at a mounting location of the head. The insert is of a material having a high temperature and high pressure resistance to creep so as to substantially avoid any plastic deformation of the cylinder head.

7 Claims, 6 Drawing Figures

LIGHT METAL CYLINDER HEAD FOR INTERNAL COMBUSTION ENGINE

BACKGROUND OF THE INVENTION

This invention relates generally to a cylinder head of light metal for internal combustion engines, especially diesel engines, and more particularly to such a cylinder head as containing an insert of a material having a high temperature and high pressure resistance to creep for avoiding plastic deformation of the cylinder head especially in the vicinity of a hot spot or spots at which the head is bolt connected to the cylinder or crankcase.

As is well known, the sealing surface between a light metal cylinder head (of for example, an aluminum alloy) and a heavy metal cylinder, is a critical interface and seals of various types have been utilized for effecting a tight seal. Also, because of the position of the intake and exhaust passages, the cylinder head has dissimilar temperature portions with the hottest spots or portions being in the vicinity of the exhaust passage. Consequently, these hot spots exhibit the greatest thermally conditioned expansion of the light weight material. Threaded fasteners, such as screws or bolts and nuts are normally employed for tightly interconnecting the head and cylinder together as the fasteners extend through a plurality of bores evenly distributed over the circumference of the head. These fasteners are typically of a heavy metal and have a substantially lower temperature expansion characteristic than the aluminum cylinder head. One or more of the fasteners extend through the aforementioned hot spot or spots with the heads or nuts thereof engaging the outer bearing surface of the cylinder head through which the fastener bores extend. Because of the high forces or loads generated by the fasteners at the bearing surface and at the corresponding sealing surface in the presence of the prevailing hot spots and the considerably reduced resistance to creep of the aluminum head, the cylinder head evidences plastic deformation in its hot regions. The tight seal at the sealing surface thus deteriorates even in the presence of a sealing gasket.

SUMMARY OF THE INVENTION

It is an object of the present invention to improve upon the cylinder head of the aforedescribed type by the provision of an insert therein at the region or regions of elevated temperature, the insert having an opening coaxial with at least one of the fastener bores at such region, and the insert having an outer face defining the bearing surface thereat. The insert is of a material having a high temperature and high pressure resistance to creep so that any plastic deformation of a cylinder head at its high temperature region is substantially avoided.

Other objects, advantages, and novel features of the invention will become more apparent from the following detailed description of the invention when taken in conjunction with the accompanying drawings.

DETAILED DESCRIPTION OF THE INVENTION

Figure 1:
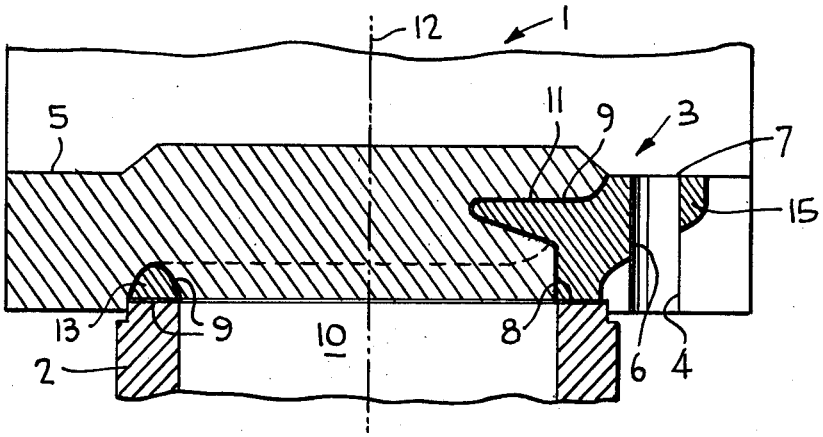
FIG. 1 is a vertical sectional view of one embodiment of a cylinder head according to the invention shown with its associated cylinder barrel, the sectioned insert being taken substantially along the line 1—1 of FIG. 3.
Figure 2:
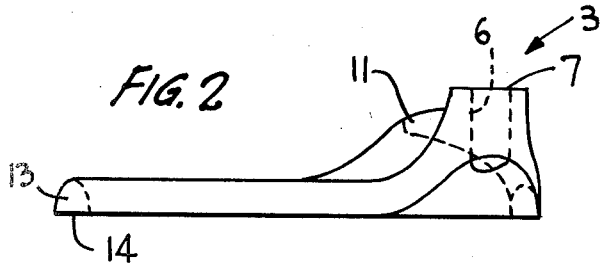
FIGS. 2 and 3 are respectively side elevational and top plan views of the insert of FIG. 1, the cylinder head or barrel not being shown in the interest of clarity.
Figure 3:
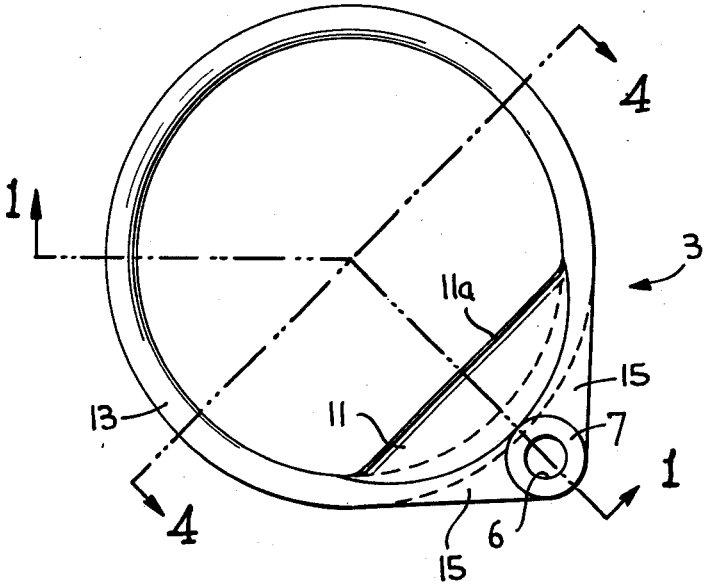
Figure 4:
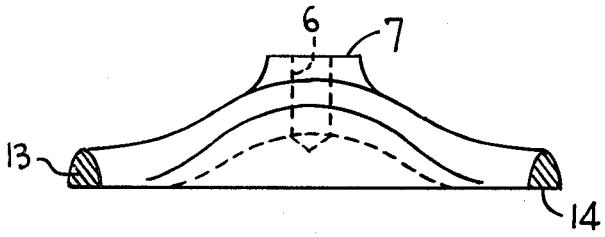
FIG. 4 is a sectional view of the insert taken substantially along the line 4—4 of FIG. 3.

Turning now to the drawings wherein like reference characters refer to like and corresponding parts throughout the several views, a cylinder head 1 of light metal, such as an aluminum alloy, is shown in FIG. 1 associated with its cylinder barrel 2 generally of heavy metal. Only those portions of the cylinder and improved head are illustrated which are necessary to the understanding of the invention. The head has at least one bore 4, or several as in FIG. 5 evenly distributed over the circumference thereof, which extends from an outer bearing surface 5 with which the heads or nuts of the fasteners (not shown) engage for interconnecting the head with the cylinder or with the crankcase in the normal manner. At least one portion of the cylinder head in the vicinity of the exhaust passage (not shown) has an elevated temperature relative to the remainder of the head. An insert 3 according to the invention is disposed in this hot region and has an opening 6 coaxial with bore 4, and likewise has an outer face 7 defining the bearing surface for the head or nut of the fastener used to fix the cylinder head in place. The insert may be of a nickeliferous ferrous material (e.g., Ni-resist) which has a co-efficient of expansion substantially the same as the light metal cylinder head of aluminum alloy material. However, this insert material has a high temperature and high pressure resistance to creep unlike that of the aluminum. Other materials forming the insert may be utilized having a dimensional stability at high temperatures.

With the improved cylinder head construction as aforedescribed, the forces or loads generated by the threaded fasteners can be absorbed almost completely by the insert which, during engine operation at the temperature prevailing at the location of the insert, has a substantially higher temperature and pressure resistance to creep than the light metal cylinder head. Accordingly, any plastic deformation of this cylinder head at the locus of the insert is substantially avoided. The tight sealing effect between the cylinder head and the cylinder barrel thus remains undisturbed.

Also as seen in FIG. 1, the insert extends as at 8 to the sealing surface defined between the cylinder head and the cylinder barrel. Thus, at high engine operating temperatures, the bottom end 8 of the insert forms the sealing surface with the cylinder barrel at the hottest spot of the cylinder head. Thus, no aluminum material is exposed directly to the compression forces generated by the screw fasteners.

Another feature according to the invention includes the provision of a layer of sealing material 9 encasing the insert so as to span the boundary gap between the insert and the cylinder head material. Thus, the conbustion pressures generated in combustion chamber 10 are less apt to cause leakages between the insert and the cylinder head which would deleteriously affect the gas tightness of the cylinder head. This sealing material may be in the form of a sealing disc or a thin layer of an aluminum alloy similar to that of the cylinder head. Such a layer is so thin that the compressive forces or loads generated by the screw fasteners are nevertheless absorbed by the insert.

The insert in the area of the hot spot or spots is substantially T-shaped in cross-section with bearing surface 7 thereof lying parallel to bottom surface 8. As seen in FIG. 1, bearing surface 7 lies in one leg of the T-shape and the other leg thereof is defined by a projection 11 in the form of a sector of a circle which resembles a partial cover having an inner edge 11*a* extending over the combustion chamber toward cylinder axis 12. This projection 11 effectively shields the heat flow from the hot exhaust passage to the bottom of the cylinder head. In air-cooled cylinder heads the exhaust passage is so arranged that, when viewed from the flowing cooling air, the insert lies at the exhaust side.

The insert may further include an integral ring 13 of the same material as its T-shaped portion, the ring being located in the bottom of the cylinder head and having a flat lower surface 14 which forms a sealing surface with the cylinder barrel. In such manner, the corresponding sealing surface of the cylinder barrel engages only that material of which the insert is formed. Otherwise, the ring may be interrupted at those areas of the cylinder head which are not determined as hot spots. Although it is known to utilize rings of high creep-resistant material in the area of the sealing surface, such rings have the exclusive function of defining the sealing surface in which, because of the different co-efficients of expansion of the cylinder head and cylinder barrel, different thermal expansions occur resulting in additional wear.

On the other hand, with the present arangement the forces generated by the threaded fasteners act upon the sealing surface and are absorbed almost completely by the insert being of a material other than an aluminum alloy from which the cylinder head is formed. Since the higher creep-resistant materials which can be utilized for the insert have a low thermal conductivity, the size of the insert should be minimized so as to prevent the heat dissipation characteristic of the cylinder head from deteriorating.

And, the bearing surface 7 portion of the insert is joined to ring 13 as at 15. Although only a single T-shaped portion of the insert has been illustrated, it should be noted that other such portions may be included at other threaded fastener locations depending on the situs of the hot spots. Such portions would, of course, be interconnected by ring 13 of the same material. Thus, depending on the nature of the stresses produced by the fasteners, some or all of the screw or bolt forces will act only indirectly on the material of the cylinder head so that deformation of the cylinder head is practically avoided.

Figure 5:
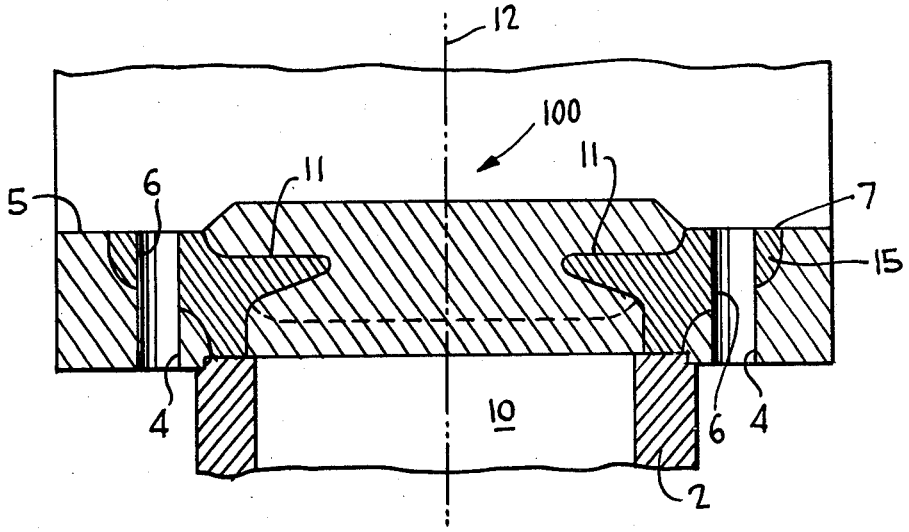
FIG. 5 is a view similar to FIG. 1 of another embodiment of a cylinder head according to the invention.

Cylinder head 100 is shown in FIG. 5 and is essentially the same as cylinder head 1 of FIG. 1 except that a plurality of T-shaped portions of an insert 30 are associated with a plurality of fastener bores 4 of the head. The same reference numerals representing the same elements between the two cylinder head embodiments, have therefore been applied. And, the layer 9 of sealing material has been omitted from FIG. 5 in the interest of clarity.

Figure 6:
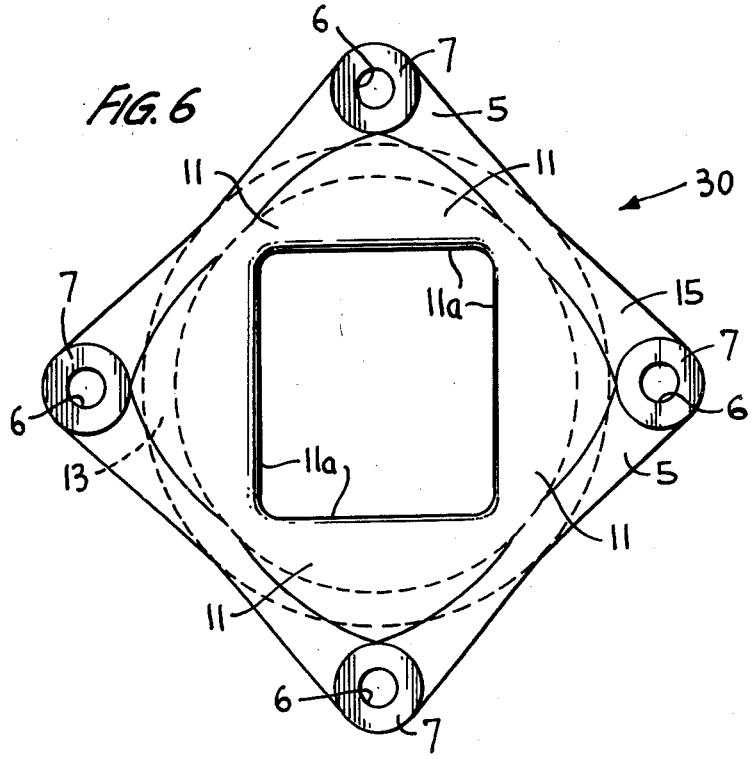
FIG. 6 is a top plan view of only the insert of FIG. 5.

Bearing surface 5 of the head is defined by four outer faces 7 of insert 30 (FIG. 6), and ring 13 interconnects the four T-shaped portions of the insert which each include a projection 11 having an inner edge 11*a* together defining a central opening and extending over combustion chamber 10 toward cylinder axis 12.

Further in accordance with the present invention, the insert of both embodiments is molded into a recess provided in the cylinder head which conforms to the intended shape of the insert. Therefore, since the forces exhibited by the threaded fasteners have virtually no effect upon the area of the cylinder head bottom, molding of the insert in place avoids any shifting of the cylinder head bottom relative to the insert in the presence of high gas pressures in the combustion chamber which occur, for example, in supercharged internal combustion engines.

Obviously, many modifications and variations of the present invention are made possible in the light of the above teachings. For example the T-shaped portion of the insert may be associated with each mounting location of the cylinder head with or without an interconnecting ring 13, or such portion may be formed as a closed continuous ring defining bearing surface 5 for the fasteners. And, a sealing ring of known construction may be provided at the sealing surface between the cylinder head and the cylinder barrel. It is therefore to be understood that within the scope of the appended claims the invention may be practiced otherwise than as specifically described.

What is claimed is:

1. A cylinder head of light metal for connection by threaded fasteners with a cylinder of heavy metal of an internal combustion engine, the head having a predetermined temperature and pressure resistance to creep and having a plurality of bores evenly distributed over a circumference thereof and extending from an outer bearing surface, the head also having a sealing surface arranged for engagement with a corresponding surface of the cylinder, the fasteners extending through the bores in engagement with the bearing surface and generating high forces thereat and at said sealing and corresponding surfaces, at least one portion of the head in a vicinity of an exhaust passage of the cylinder head having an elevated temperature relative to a remainder of the head, the improvement wherein one fastener extends through one bore located in said one portion, and an insert is provided at said one portion of the head, wherein said insert at said one portion is substantially T-shaped in cross-section with said bearing surface thereof lying parallel to said sealing surface thereof, said bearing surface lying in one leg of the T-shape and another leg thereof being defined by a projection extending toward a central cylinder axis, said insert having an opening coaxial with said one bore and having an outer face defining said bearing surface for the head of said one fastener, and said insert being of a material having a higher temperature and a higher pressure resistance to creep than said predetermined temperature and pressure resistance to creep of the head, whereby any plastic deformation of the cylinder head at said one portion, as caused by high forces, is substantially avoided.

2. The cylinder head according to claim 1, wherein a plurality of portions of the head in a vicinity of the exhaust passage have elevated temperatures relative to a remainder of the head, said fasteners extending through said bores in said portions, said insert being provided at each of said portions and including a continuous ring.

3. The cylinder head according to claim 1 or 2, wherein said insert extends to said sealing surface.

4. The cylinder head according to claim 1 or 2 wherein a layer of sealing material is disposed between said insert and the cylinder head to avoid any leakages through an interface of said insert and head affecting the gas tightness of the head.

5. The cylinder head according to claim 4, wherein said layer is comprised of said light metal.

6. The cylinder head according to claim 1, wherein said insert includes a ring of said material extending to said sealing surface.

7. The cylinder head according to claim 1 or 2, wherein said insert is molded into the cylinder head and has a projection extending toward a cylinder axis and lying parallel to said sealing surface.

* * * * *